United States Patent [19]

Smith

[11] Patent Number: 4,505,863

[45] Date of Patent: Mar. 19, 1985

[54] CARBURETOR

[76] Inventor: Arthur J. Smith, P.O. Box 96, Donnelly, Id. 83615

[21] Appl. No.: 548,700

[22] Filed: Nov. 4, 1983

Related U.S. Application Data

[63] Continuation-in-part of Ser. No. 376,108, May 7, 1982, abandoned, which is a continuation of Ser. No. 178,579, Aug. 15, 1980, abandoned.

[51] Int. Cl.[3] ..... F02M 7/22

[52] U.S. Cl. ..... 261/34 A; 261/44 A; 261/44 E; 261/DIG. 81

[58] Field of Search ..... 261/44 A, 44 E, DIG. 81, 261/34 A

[56] References Cited

U.S. PATENT DOCUMENTS

| | | | |
|---|---|---|---|
| 2,214,273 | 9/1940 | Fish | 261/44 A |
| 2,236,595 | 4/1941 | Fish | 261/44 A |
| 2,801,086 | 7/1957 | Fish | 261/44 A |
| 3,132,191 | 5/1964 | Kennedy, Sr. | 261/44 A |
| 3,278,171 | 10/1966 | Carlson | 261/39 D |
| 3,291,464 | 12/1966 | Hammerschmidt et al. | 261/44 A |
| 3,847,288 | 8/1958 | Taylor | 261/44 A |
| 3,916,859 | 11/1975 | Fossum | 261/DIG. 20 |
| 3,943,207 | 3/1976 | Harootian | 261/44 A |
| 4,066,720 | 1/1978 | Carter | 261/44 B |
| 4,164,525 | 8/1979 | Bernecker | 261/44 A |

FOREIGN PATENT DOCUMENTS

| | | | |
|---|---|---|---|
| 1365194 | 8/1974 | United Kingdom | 261/44 A |

*Primary Examiner*—Tim Miles

*Attorney, Agent, or Firm*—Emory L. Groff, Jr.

[57] ABSTRACT

A carburetor includes a pendulum metering element delivering fuel to a hollow throttle shaft from a fuel metering chamber by means of a graduated depth groove in the chamber wall which is engaged by a spring urged jet member carried by the pendulum element and offering constant fluid-tight engagement with the chamber groove with minimum frictional drag. Stability of both fuel metering/vaporization throughout variations in temperature is significantly enhanced by formation of the carburetor body from a machined block of a metal selected for its ideal combined capability of heat storage and dissipation. An improved sealing assembly between a float and fuel chamber and the metering chamber coupled with a regulator device insuring a constant fuel inlet pressure enhances this stability of operation.

7 Claims, 12 Drawing Figures

CARBURETOR

This is a continuation-in-part of application Ser. No. 376,108, filed May 7, 1982, now abandoned, which was a continuation of application Ser. No. 178,579, filed Aug. 15, 1980, now abandoned.

This invention relates generally to carburetors for internal combustion engines and more particularly, to a carburetor having improved fuel metering means associated with a carburetor structure exhibiting superior stability throughout variations in operating temperatures.

In the present invention, a fuel metering structure is employed including a swingable pendulum which is arcuately displaced along with the butterfly valve or throttle plate to precisely deliver fuel from a chamber surrounding the pendulum to the throat of the carburetor by means of a hollow throttle shaft provided with fuel jets beneath the supported throttle plate.

To those skilled in the art, the foregoing general arrangement as broadly described will be quite familiar. U.S. Pat. No. 2,236,595 dated Apr. 1, 1941 and U.S. Pat. No. 2,801,086 dated July 30, 1957, both issued to Fish, disclose this principle of operation. Unfortunately, many earlier efforts to provide reliable and efficient carburetors of the type commonly referred to as a Fish carburetor have fallen short of expections. One problem with such prior devices related to air and/or fuel leakage between certain movable components which quite obviously affected the operation of the carburetor both from the standpoint of precision metering and fuel efficiency. Another shortcoming concerned the lack of a satisfactory accelerator pump operation in spite of direct attempts made to secure this required performance in earlier carburetors. Perhaps an even more important problem encountered in some earlier carburetors was the unreliability thereof during operation due to inevitable fluctuation in the ambient and structural temperature.

U.S. Pat. No. 3,291,464 issued Dec. 13, 1966 to Hammerschmidt et al recognized this latter deficiency in carburetors of the Fish type. To accommodate variation in the air temperature and also the humidity and elevation, Hammerschmidt et al proposed an either manually or automatically adjustable element cooperating with the fuel metering pendulum, an approach to the stated problem which is totally unlike that being offered herein.

The present invention proposes an improved carburetor structure comprising a substantially simplified arrangement overcoming shortcomings of prior known devices and resulting in a carburetor having improved precision in the fuel metering operation, which function exhibits a high degree of consistency or reliability throughout variations in temperature conditions. The foregoing is achieved by a combination of unique improvements. Resistance to fluctuations in the operating temperatures and thus a more consistently stable temperature for both the carburetor components as well as the fuel therein is achieved by the provision of a substantially massive main carburetor body constructed of suitable material such as aluminum and which will exhibit the best combination of the capability of heat storage and dissipation. More reliable fuel metering, including acceleration pump operation, is obtained by the formation of a pendulum construction which is designed to capture and encourage, transmission or delivery of the correct amount of fuel from a surrounding fuel chamber to the throat of the carburetor. Maintenance of this precision delivery of fuel is accomplished by the inclusion of improved sealing and jet means associated with the displaceable pendulum.

Accordingly, one of the objects of the present invention is to provide an improved carburetor including a main body comprising a substantial mass of solid metal selected to provide both adequate heat retention and dissipation to discourage icing, vapor lock and undesirable fluctuations of precision fuel metering due to temperature variations.

Another object of the present invention is to provide an improved carburetor having fuel metering means comprising a displaceable pendulum having a configuration on its operating surfaces selected to achieve precision delivery of fuel to the throat of the carburetor during both normal and accelerating motion of the throttle.

Still another object of the present invention is to provide an improved carburetor having a pendulum-type metering element provided with a fuel passage opening on its inside face surrounded by a spring-urged jet element constructed of material having a low coefficient of friction.

A further object of the present invention is to provide an improved carburetor having a swingable fuel metering element connected to one end of a throttle shaft with sealing and bearing means at the connected end of the shaft maintained in engagement with the metering element by means of spring means constantly acting upon the opposite end of the throttle shaft.

With these and other objects in view which will more readily appear as the nature of the invention is better understood, the present invention consists in the novel construction, combination and arrangement of parts hereinafter more fully described, illustrated and claimed.

Similar reference characters designate corresponding parts throughout the several figures of the drawings.

Figure 1:
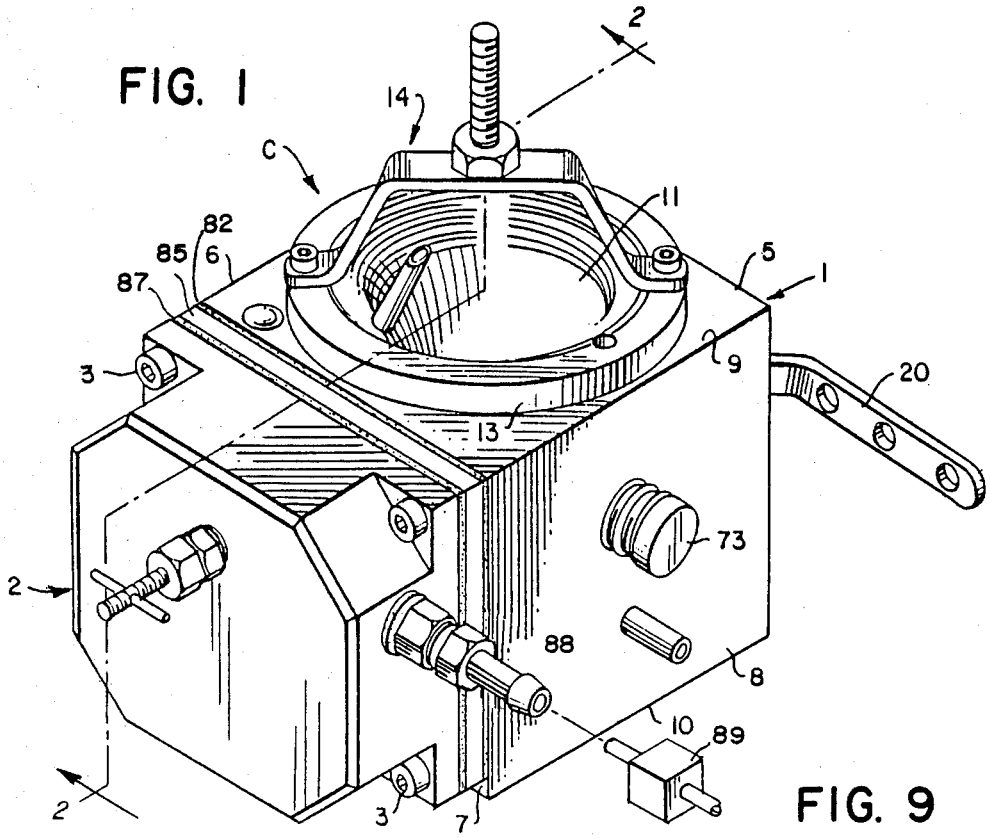
FIG. 1 is a top perspective view of a carburetor according to the present invention.

Referring now to the drawings, particularly FIG. 1, the present invention will be understood to relate to a carburetor generally designated C and including two principal external components, namely the main carburetor body or block 1 and the float bowl body or block 2 which is attached to one side face the main body by means of removable fasteners 3. The two blocks 1 and 2 are not of stamped or deformed material but are preferably machined from two solid blocks of cast metal such as aluminum and the relative thickness of the portions of these components will be readily appreciated from a review of FIG. 2 of the drawings, wherein it will be seen that the solid metal portion of the two blocks is substantial with respect to the machined portions thereof. By selecting a metal such as aluminum, it has been found that the best combination of both heat storage and heat dissipation will be achieved and these features in turn are only realized when the massive extent of the volume of solid metal in the carburetor bodies 1 and and 2 is substantial. Experience has shown, that as a guide, the total transverse thickness of the cubic body 1 exclusive of the central throat 4 should be greater than the diameter of the centrally disposed throat 4. In this manner, a sufficient mass of the solid metal will radially extend beyond the entire periphery of the throat to yield the optimum combination of capability for heat storage and heat dissipation thereby reducing the tendency of vapor lock on the one hand as well as discouraging icing on the other hand. In addition, this capability enhances fuel efficiency by maintaining stability throughout all operating ranges of the fuel metering system. The inclusion of supplemental heating means as is well known in the art may of course, be practiced.

For ease of assembly and economy of manufacture, the main body 1 is preferably formed as a square block or cube having four side faces 5, 6, 7 and 8 bounded by a top wall 9 and bottom wall 10. The throat 4 extends vertically through the center axis of the body 1 and includes an upper, enlarged flared bore 11 communicating with the cylindrical lower, high speed, low pressure area 12 of the throat. The top wall 9 may be provided with a cylindrical upper section 13 associated with a mounting assembly 14 for the reception and retention of an appropriate air cleaner mechanism (not shown) while the bottom wall 10, which includes the throat outlet 15, is intended to be mounted upon an appropriate intake manifold or an adapter therefor. A pivotal shaft 16 is disposed through two axially aligned bores 17–18 through the center of the main body 1 with the shaft bore 17 disposed through the first side face 5 of the main body and the shaft bore 18 disposed through the opposite, third side face 7 of the body. The outer actuating end 19 of the shaft 16 projects beyond the first side face 5 of the body for the reception of an appropriate throttle control lever 20 while the inner end 21 of the throttle shaft 16 projects beyond the inner wall 22 of a fuel metering chamber 23 formed as a cavity within the confines of the main body side face 7.

For reasons which will become obvious hereinafter, the distal portion of the shaft inner end 21 extends outwardly to a point short of the plane of the main body side face 7. The shaft 16 is journaled and sealed against fluid leakage adjacent both its ends as shown most clearly in FIG. 2 of the drawing. A recess 24 surrounds the periphery of the shaft 16 adjacent the block first side face 5 and contains an exterior plug 25 behind which is a circular seal 26 of suitable material such as nylon or teflon suitably affixed relative the rotatable shaft. A spring element 27 is disposed within the recess 24 and bears on the one hand against the bottom 28 thereof and on the other hand against the inner surface of the seal 26 whereupon it will be understood that a constant force will be applied by this spring tending to axially urge both the seal 26 and the shaft toward the direction of the first side face 5 of the carburetor main body and the purpose of which will be more fully appreciated hereinafter.

The opposite or inner end 21 of the shaft 16 is also provided with an appropriate fluid tight seal about the periphery of the shaft comprising the teflon member 29 contained within a recess 30 juxtaposed the inner wall 22 of the fuel metering cavity 23. Attached to the medial portion of the shaft 16 spanning the throat 4 is a butterfly valve or throttle plate 31 and which cooperates with the pivoting of the shaft by means of the throttle control lever 20 to vary volume of air as fuel is delivered into the main body throat 4 as indicated by the lowermost arrows in FIG. 2 of the drawings. Fuel is admitted to this point through a plurality of jets 32 formed through the lower portion of the shaft 16 which communicate with an axially extending bore 33 within the shaft, which bore extends to the inner end 21 thereof. As will be noted, the inner end of the shaft 16 is formed within an enlarged valve seat 34 which forms, with the needle 35, a fuel flow adjusting needle valve assembly regulating the amount of fuel passable through the bore 33 of the pivotal shaft 16 to the issuing jets 32.

A constant level of fuel is delivered to the fuel metering chamber 23, which supplies the metering means associated with the needle valve assembly 34–35, by means of suitable structure contained within the float bowl body 2 and which is attached in direct communication with the main body third side face 7. The float bowl body 2 contains a float and fuel chamber 36 housing the float bowl 37 appropriately suspended therein such as by the hinge pin 38 and which regulates a fuel feed valve 39 forming a part of a fuel inlet fitting 40.

Figure 2:
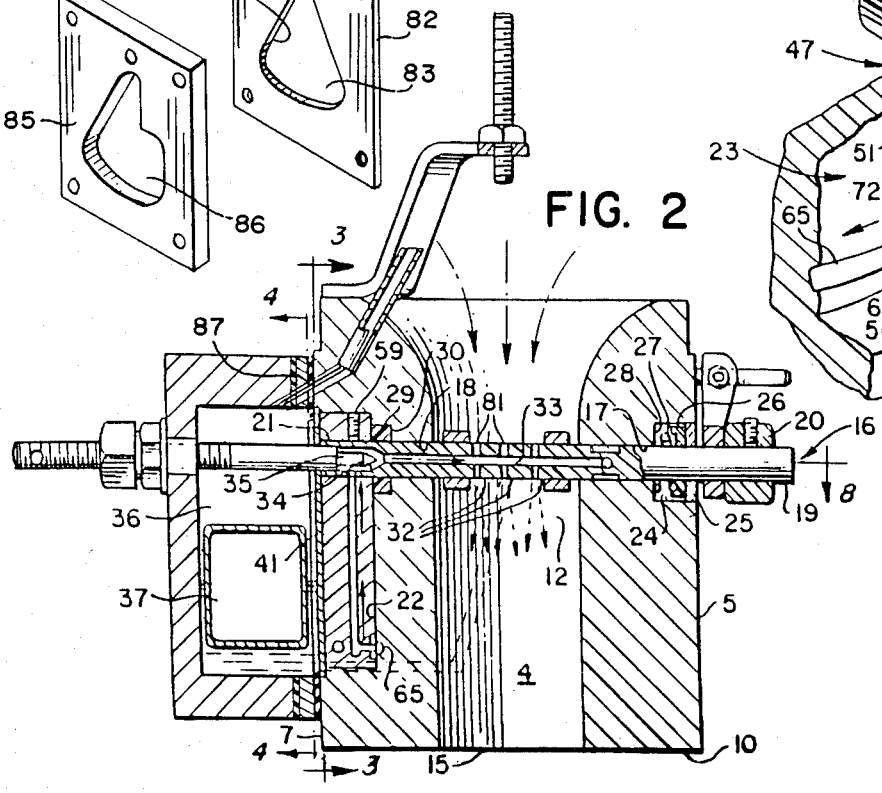
FIG. 2 is a vertical sectional view taken along the line 2—2 of FIG. 1.
Figure 3:
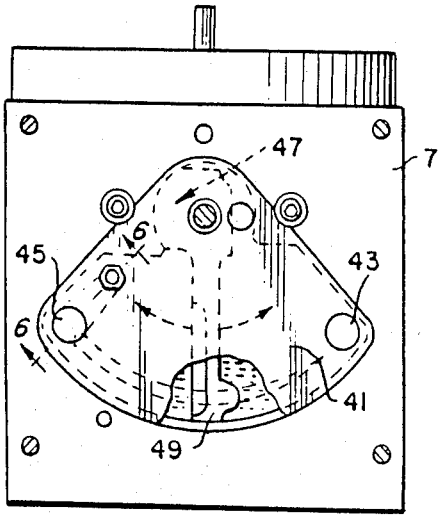
FIG. 3 is a vertical sectional view taken along the line 3—3 of FIG. 2.
Figure 4:
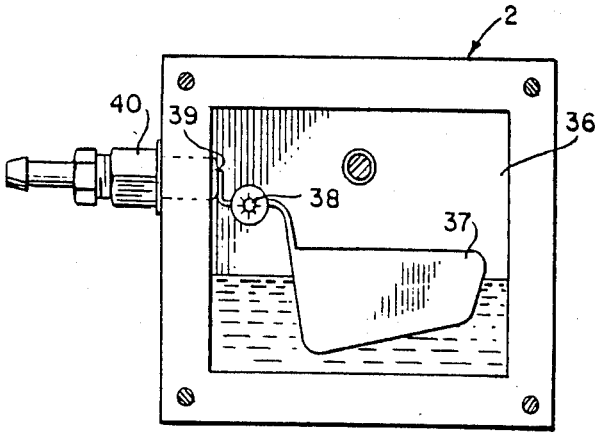
FIG. 4 is a vertical sectional view taken along the line 4—4 of FIG. 2.

From a review of FIGS. 2 and 3 of the drawings, it will be seen that the vertical plane disposed between the float and fuel chamber 36 and fuel metering chamber 23 is partially closed by means of the intermediate reed plate and pendulum shield 41 which member forms a close mating fit within the confines of the recessed shoulder 42 formed in the main body third side face 7 adjacent the periphery of the metering chamber 23. The plate member 41 is imperforate except for an unobstructed supply opening 43 juxtaposed the lower corner of a closed-throttle side 44 of the chamber 23 and a normally open, valved opening 45 adjacent the lower corner of an opened-throttle side 46 of the chamber 23.

With the fuel line serving the inlet fitting 40 opened, it will be understood that the float chamber 36 will normally be filled to the prescribed level defined by the operating float bowl 37 and this same fuel will flow laterally through the openings 43 and 45 to fill the fuel metering chamber 23 with fuel to the same level. This referenced level will at all times overlie the two openings 43,45 through the reed plate 41 such that a supply of fuel will always exist in the lower portion of the metering chamber 23 to be acted upon during subsequent operation of the throttle shaft 16 to deliver a precisely metered amount of fuel from the metering chamber 23 to the jets 32 associated with the butterfly valve 31.

Figure 9:
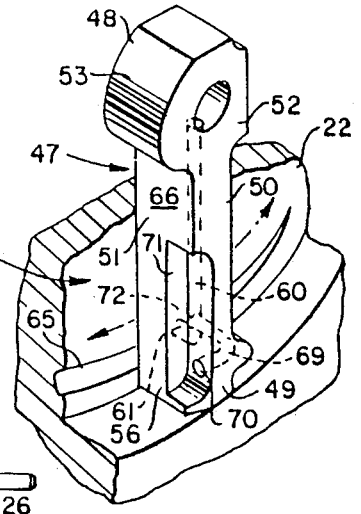
FIG. 9 is an enlarged, partial perspective view of the pendulum and its passages.

The above referenced metering of fuel is accomplished by means of a fuel metering element comprising the pendulum 47. The details of the construction of the swingable pendulum 47 are shown most clearly in FIGS. 2, 5 and 9 of the drawings wherein it will be seen that the pendulum comprises an elongated body comprising a head 48 joined to a foot 49 by an intermediate shaft 50. The overall axial thickness of the pendulum is constant as defined by a planar inside face 51 and outside face 52 respectively juxtaposed the fuel metering chamber inner wall 22 and reed plate 41. The head 48 of the pendulum includes an enlarged portion on the leading side of the shaft 50 and which is provided with a curved surface 53 forming a close sliding fit with a mating surface 54 of an enlargement 55 projecting inwardly from the opened-throttle side 46 of the metering chamber 23 as shown most clearly in FIG. 5 of the drawings. The bottom surface 56 of the foot 49 is defined by a curved surface of relatively large area mating with and closely disposed with respect to the constant radius curvature of the bottom wall 57 of the fuel metering chamber 23 such that a negligent amount of fuel flow-by occurs therebetween during swinging displacement of the pendulum between the two opposite sides 46 and 44 of the chamber.

The above described pendulum 47 is rigidly affixed with respect to the pivotal throttle shaft 16 by means of a transverse bore 58 through the head 48 and which communicates with the periphery of the shaft inner end 21 with an appropriate fastener 59 therein. The pendulum is fastened to the shaft in the correct relationship whereby when the butterfly valve 31 is in the closed or substantially horizontal position, the pendulum will be displaced with its foot 49 disposed within the closed-throttle side 44 of the fuel metering chamber 23.

Figure 10:
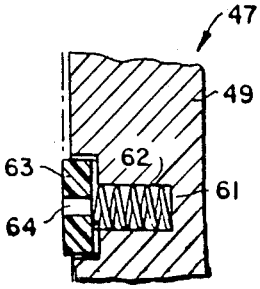
FIG. 10 is an enlarged sectional view taken along the line 10—10 of FIG. 5.

Upon operation of the throttle control lever 20, the shaft 16 and its butterfly valve 31 will be arcuately displaced concurrently with a similar arculate displacement of the pendulum 47 with its foot 49 being moved from the closed-throttle side 46 of the chamber 23. During this displacement, fuel is transmitted from the chamber 23 to the interior bore 33 of the shaft 16 and ultimately through the jets 32, by means of a primary passage 60 extending from the bore 58 in the head of the pendulum downwardly through the shaft 50 to an angular extension 61 communicating with the inside face 51 at a point adjacent the lower portion of the pendulum. As shown in the enlarged detail view of FIG. 10 of the drawings, the extension 61 is provided with a compression spring 62 bearing upon a friction-free jet seal member 63 provided with a central bore 64. Suitable material for the member 63 may comprise teflon and this member will be understood to be constantly urged into a fluid-tight engagement with the inner wall 22 of the metering chamber 23 with its bore 64 at all times communicating with a metering groove 65 formed in the chamber inner wall 22. This metering groove 65 describes an arc concentric with that of the chamber bottom wall 57 and comprises a variably increasing cross-sectional area from its end adjacent the closed-throttle side 44 to the opened throttle side 46.

Figure 5:
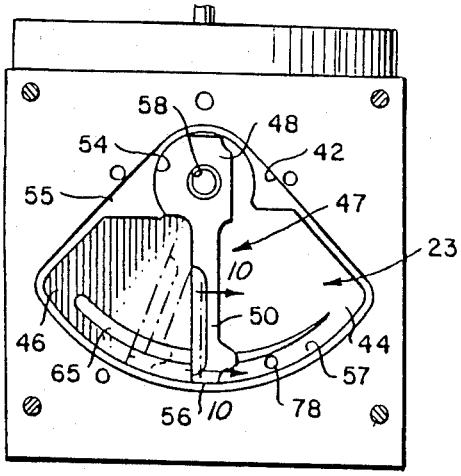
FIG. 5 is a view similar to FIG. 3 with the reed plate removed.

With the above described structure in mind, the operation of the carburetor during a gradual opening of the butterfly valve 31 should be readily apparent. With the concurrent arcuate displacement of the pendulum 47 such as from the full line to the broken line positions as shown in FIG. 5 of the drawings, the seal member 63 carried by the inside face 51 of the pendulum slides over the metering groove 65 with a progressively larger cross-sectional area of the groove being presented to the jet or bore 64 thereof such that a correspondingly greater amount of fuel is admitted through the member 63 and thence directed successively through the passageways 61–60, the bore 33 of the throttle shaft 16 and outwardly through the jets 32 in the carburetor throat 4.

Figure 7:
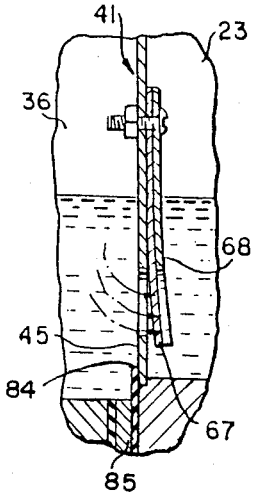
FIG. 7 is a view similar to FIG. 6 and illustrates the reed valve in its normally opened position to admit fuel therethrough.

The improvements offered by the present invention produce a far greater degree of precision in the fuel metering operation than was possible in earlier carburetors of the Fish type. The substantial expanse of the planar surfaces of the pendulum inside face 51 and outside face 52 provide improved sealing with the juxtaposed metering chamber inner wall 22 and reed plate 41 respectively, such that upon displacement of the pendulum toward the opened throttle end 46 of the metering chamber a minute but significant hydraulic pressure is built up by the body of fuel engaged by the leading face 66 of the pendulum which pressure assists in directing this fuel into the metering groove 65 and thence through the bore 64 of the jet member 63. The inside face 51 of the pendulum 47 does not frictionally engage the inner wall 22 of the metering chamber 23 but is retained in a very close relationship therewith to preclude the passage of a noticeable amount of fuel therebetween while allowing of relative displacement without measureable friction. This relationship is achieved by means of the seal 29 associated with the inner end 21 of the pivotal shaft 16, it being understood that the outer face of this seal engages the inside face 51 of the head 48 of the pendulum while the exposed face of the jet seal 63 located in the foot 49 of the pendulum surrounding the passageway extension 61 provides the only point of actual contact other than the seal 29, between the pendulum and the chamber inner wall 22. This two-point contact provided by sliding sealing means having a very low co-efficient of friction results in a substantially improved reliability and precision of fuel metering during the above referenced gradual opening of the throttle and advancement of the pendulum toward the opened throttle end 46 of the metering chamber. Fuel ahead of the pendulum leading face 66 is maintained at the same level as that present in the float chamber by means of the valved opening 45 which is normally open, as in FIG. 7 while the opening 43 maintains the fuel level in the metering chamber 23 behind the pendulum.

Figure 6:
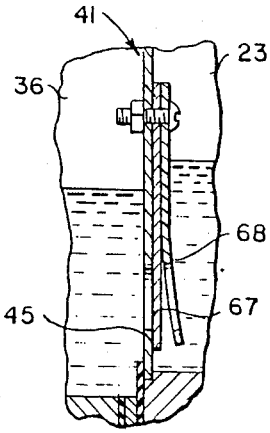
FIG. 6 is a transverse sectional view taken along the line 6—6 of FIG. 3.

During rapid acceleration, when the pendulum 47 is moved quickly toward the opened throttle side 46 of the metering chamber 23, the sudden reduction of the chamber volume ahead of the pendulum fills this area with fuel and the resultant hydraulic pressure by the fuel entrapped ahead of the pendulum leading face 66 bears against the flexible reed valve 67 and displaces same from its normal opened position supported by the apertured back plate 68, to the closed sealing position as shown in FIG. 6 of the drawings. The enlargement 55 within the metering chamber 23 cooperates with the curved surface 53 of the pendulum head 48 to reduce the volume within the metering chamber that is available when the pendulum is rapidly accelerated toward the opened-throttle side 46 thereby further assisting in the early build up of pressure by the fuel beneath the enlargement 55 so that a greater amount of fuel will be forced into the enlarged portion of the metering groove 65 in front of the pendulum leading face 66 with the result that an increased amount of fuel will be forced through the pendulum passageways 61,60 and subsequently through the jets 32 and into the carburetor throat 4. Any tendency for an excessive hydraulic pressure to be developed during a rapid acceleration is relieved by means of a by-pass passageway 69 having an entrance opening 70 formed in the recess 71 in the pendulum leading face 66. As shown most clearly in FIG.

9 of the drawings, this by-pass passageway 69 is provided with an exit 72 communicating with the metering groove 65 at a point immediately behind the angular extension 61.

The by-pass passageway 69 actually performs an important function during both normal and rapid movement of the throttle. During normal advancement of the pendulum to the opened-throttle side 46 of the metering chamber 23, the passageway 69 insures that the portion of the metering groove 65 behind the angular extension 61 remains filled with fuel. During rapid acceleration, this same function is performed by the passageway 69 and becomes even more important to preclude cavitation occuring at a point so close to the jet seal member 63 associated with the passageway 61. Additionally, during rapid acceleration, the passageway 69 performs the important function of serving as a relief valve or by-pass to preclude excessive hydraulic pressures being developed within the metering chamber 23 ahead of the pendulum leading face 66.

Figure 8:
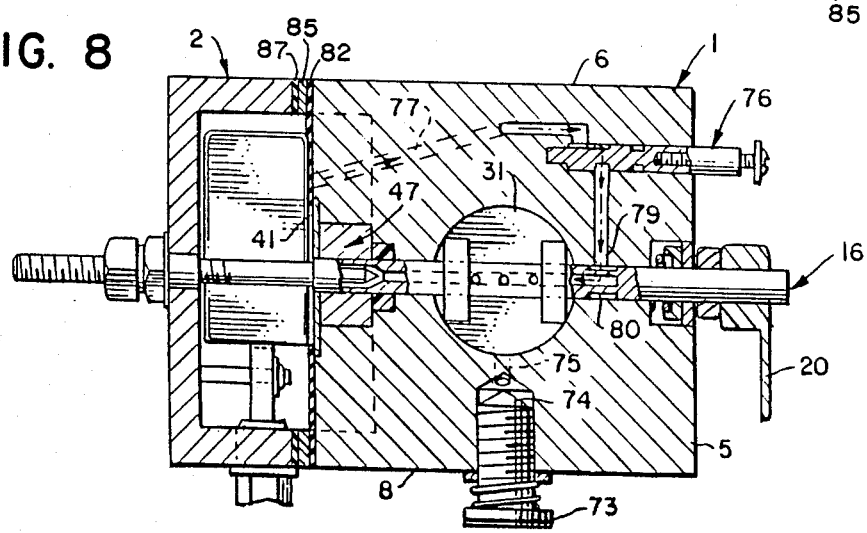
FIG. 8 is a horizontal sectional view taken along the line 8—8 of FIG. 2.

Means for adjusting the idle operation of the carburetor C is provided by an idle air adjust screw 73 threadedly displaceable through the main block fourth side face 8 as shown most clearly in FIG. 8 of the drawings. This screw includes a valve nose 74 displaceable to variably engage the juncture between a pair of divergent holes 75 serving to bypass the throttle plate 31 when in the closed position so that by manipulating the screw 73 the port at the juncture of the two holes 75 is variably sealed off by the screw nose 74 to control the idle speed of the associated engine by regulating the amount of air that by-passes the closed throttle plate.

Choke means are included to enable starting of a cold engine and includes a suitable choke valve 76 accessible on the main block first side face 5 and which may be manipulated by any well known manual cable means or automatic thermostatic means to open and close same. This valve is in series with a fuel passageway 77 having a supply end 78 opening in the fuel metering chamber 23 at a point which is always below the level of the fuel therein and which has its delivery end 79 disposed adjacent the pivotal throttle shaft 16 at a point intermediate the seal 26 and throttle valve 31. The throttle shaft is relieved in this area as at 80 in FIGS. 2 and 8 of the drawings, which relief communicates with the end of the bore 33 therein such that fuel admitted through the passageway 77 is delivered to the throttle shaft and through the jets 32 independent of any displacement of the throttle shaft and its attached pendulum 47.

As shown in FIG. 2, the medial portion of the throttle shaft 16 may be provided with air passages 81 on its upper portion opposite the smaller fuel jets 32 on the lower portion which air passages assist in the vaporization of the fuel being drawn downwardly into the carburetor throat 4 by the lower pressure existing beneath the throttle plate 31.

Figure 11:
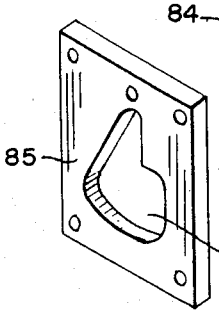
FIGS. 11 and 12 are perspective views of rigid and resilient gaskets, respectively.
Figure 12:
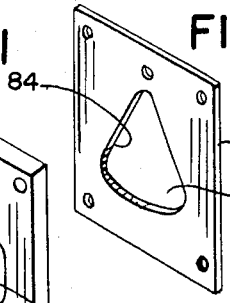

The gasket assembly shown in FIGS. 11 and 12 is an important feature insuring accurate and reliable metering of the fuel by the above described structure. The plate sealing member 82 comprises a relatively thin gasket of resilient material having a central opening 83 and is disposed in overlying relationship to the body side face 3. The inner periphery 84 of the opening projects inwardly to overlie the continuous periphery of the plate 41 to provide a positive fluid seal with the plate which is flushly seated within the body recessed shoulder 42. This positive seal is enhanced and maintained under various operating conditions by the inclusion of the rigid, substantially thicker gasket 85 which is preferably constructed of aluminum and includes the central opening 86 communicating with the opening 83 of the sealing member 82. The interdisposition of the dimensionally stable gasket insures constant sealing pressure of the member 82 against the plate 41. Completing the gasket assembly is a resilient gasket 87 disposed between the gasket 85 and float body 2.

As shown in FIG. 1, means are provided in series with the carburetor fuel inlet 88, to maintain a prescribed fuel pressure to the float bowl chamber 36. Precise operation is assured by employing a fuel pressure regulator 89 designed to maintain a pressure of 2.5 pounds. An appropriate fuel filter must also be utilized and the schematic representation of the regulator 89 will be understood to also include such a filter.

From the foregoing, it will be appreciated that an improved carburetor is provided having increased stability in its fuel metering and reliability in the resultant fuel vaporization due to unique construction of the pendulum and its sealing relationship with the surrounding fuel metering chamber together with a polygonal body block constructed of a solid mass of aluminum of substantial magnitude relative the throat to yield an ideal combination of heat storage and heat dissipation.

I claim:

1. A carburetor including, a main body having a vertical throat therethrough and a plurality of side faces, a pivotal shaft having an axial bore and extending through said body from one said side face to an opposite one of said side faces and bisecting said throat, a throttle plate carried by said shaft in said throat, fuel jets through said shaft and throttle plate, said body opposite side face provided with a recessed fuel metering chamber having an inner wall, the periphery of said metering chamber having a recessed shoulder adjacent said body opposite side face, a fuel metering pendulum within said chamber having a head affixed to one end of said shaft, said chamber including a bottom wall of fixed radius curvature, a foot on said pendulum having a bottom surface of substantial extent providing a close mating sliding fit with said chamber bottom wall, said pendulum including a planar outside face and an opposite planar inner face juxtaposed said chamber inner wall to provide a semi-seal therebetween without frictional engagement, a leading face and opposite trailing face bounding said outside and inner face, said inner wall provided with an arcuate variably cross-sectioned groove juxtaposed said pendulum foot inner face, a valved plate overlying said chamber and providing a substantial fluid seal with said pendulum outside face, said valved plate disposed within said metering chamber recessed shoulder with its outer surface flush with said body opposite side face, a plate sealing member overlying said body opposite side face and having a central opening communicating with said plate, said sealing member opening provided with an inner periphery overlying the periphery of said plate, said pendulum having an internal primary fuel passageway communicating between said foot inner face juxtaposed said groove and said head to transmit variable amounts of fuel from said chamber groove to said pivotal shaft bore, said primary passageway at said inner face including a separate seal element carried by said foot and constantly engageable with said chamber inner wall on opposite sides of said groove, said seal element including a bore allowing transmission of fuel from said chamber groove through said primary passageway to said pivotal shaft bore, said pendulum leading face having an enlarged recess extending vertically from said foot to the intermediate portion of the height of said pendulum, said recess extending laterally from said outside face to a line intermediate the transverse depth of said pendulum, a by-pass fuel passageway in said pendulum having an inlet communicating with said recess and an outlet juxtaposed said groove intermediate said primary passageway and said trailing face whereby, swinging of said pendulum in the direction of said leading face forces fuel entrapped within said recess through said by-pass passageway.

2. A carburetor according to claim 1 wherein, said plate sealing member comprises a resilient member, and a rigid gasket having a central opening overlying said sealing member.

3. A carburetor according to claim 1 including, spring means within said pendulum foot urging said seal element into contact with said chamber inner wall.

4. A carburetor according to claim 1 including, seal means surrounding said pivotal shaft adjacent both ends thereof, said seal means on said shaft adjacent said end affixed to said pendulum engaged by said pendulum head inside face to provide, along with said seal element, support of said pendulum against said chamber inner wall.

5. A carburetor according to claim 1 including, a choke fuel passageway in said main body having an inlet in said metering chamber and outlet communicating with said pivotal shaft bore, and valve means regulating the flow of fuel from said chamber through said jets.

6. A carburetor including, a main body having a vertical throat therethrough and a plurality of side faces, said main body comprising a block of metal having a total horizontal thickness of metal through the center of said throat substantially exceeding the diameter of said throat, said main body having a height substantially equal to its width, the radial thickness of said main body from said throat to the exterior of said main body being substantially greater than the radius of said throat, a pivotal shaft having an axial bore and extending through said body from said side face to an opposite one of said side faces and bisecting said throat, a throttle plate carried by said shaft in said throat, said body opposite side face provided with a recessed fuel metering chamber having an inner wall, a fuel metering pendulum within said chamber having a head affixed to one end of said shaft, said chamber including a bottom wall of fixed radius curvature, a foot on said pendulum having a bottom surface of substantial extent providing a close mating sliding fit with said chamber bottom wall, said pendulum including a planar inner face juxtaposed said chamber inner wall to provide a semi-seal therebetween, said inner wall provided with an arcuate variably cross-sectioned groove juxtaposed said pendulum foot inner face, said pendulum having an internal fuel passageway communicating between said foot inner face juxtaposed said groove and said head to transmit variable amounts of fuel from said chamber groove to said pivotal shaft bore, said passageway at said inner face constantly engageable with said chamber inner wall on opposite sides of said groove thereby allowing transmission of fuel from said chamber groove through said pendulum passageway to said pivotal shaft bore, a float body comprising a block of metal substantially fully overlying said opposite one of said main body side faces, and said main body and float body metal comprises aluminum.

7. A carburetor according to claim 6 including, regulator means maintaining a constant pressure of supply fuel to said carburetor.

* * * * *